US011450459B2

(12) United States Patent
Murai

(10) Patent No.: US 11,450,459 B2
(45) Date of Patent: Sep. 20, 2022

(54) SOFT MAGNETIC POWDER AND METHOD FOR PRODUCING SINTERED BODY

(71) Applicant: Seiko Epson Corporation, Tokyo (JP)

(72) Inventor: Takayuki Murai, Hachinohe (JP)

(73) Assignee: Seiko Epson Corporation

( * ) Notice: Subject to any disclaimer, the term of this patent is extended or adjusted under 35 U.S.C. 154(b) by 91 days.

(21) Appl. No.: 16/367,357

(22) Filed: Mar. 28, 2019

(65) Prior Publication Data

US 2019/0304645 A1 Oct. 3, 2019

(30) Foreign Application Priority Data

Mar. 29, 2018 (JP) ..... JP2018-064792

(51) Int. Cl.

| | |
|---|---|
| ***H01F 1/147*** | (2006.01) |
| ***B22F 1/00*** | (2022.01) |
| ***B22F 3/12*** | (2006.01) |
| ***C22C 19/07*** | (2006.01) |
| ***C22C 30/00*** | (2006.01) |
| ***C22C 38/02*** | (2006.01) |
| ***C22C 38/10*** | (2006.01) |
| ***C22C 38/12*** | (2006.01) |
| ***C22C 38/24*** | (2006.01) |
| ***C22C 38/30*** | (2006.01) |
| ***C22C 1/04*** | (2006.01) |
| ***C22C 33/02*** | (2006.01) |
| ***B22F 1/10*** | (2022.01) |
| ***B22F 1/052*** | (2022.01) |
| *B22F 9/08* | (2006.01) |

(52) U.S. Cl.

CPC ..... *H01F 1/147* (2013.01); *B22F 1/052* (2022.01); *B22F 1/10* (2022.01); *B22F 3/12* (2013.01); *C22C 1/0433* (2013.01); *C22C 19/07* (2013.01); *C22C 30/00* (2013.01); *C22C 33/0285* (2013.01); *C22C 38/02* (2013.01); *C22C 38/10* (2013.01); *C22C 38/12* (2013.01); *C22C 38/24* (2013.01); *C22C 38/30* (2013.01); *B22F 9/082* (2013.01); *B22F 2301/15* (2013.01); *B22F 2301/35* (2013.01); *B22F 2998/10* (2013.01)

(58) Field of Classification Search

None

See application file for complete search history.

(56) References Cited

U.S. PATENT DOCUMENTS

2013/0136926 A1 5/2013 Nakamura et al.

FOREIGN PATENT DOCUMENTS

CN 103357870 A * 10/2013
EP 0354666 A1 2/1990

(Continued)

OTHER PUBLICATIONS

Machine translation of JP 2008-248392A. (Year: 2008).*

(Continued)

*Primary Examiner* — Xiaowei Su

(74) *Attorney, Agent, or Firm* — Harness, Dickey & Pierce, P.L.C.

(57) ABSTRACT

A soft magnetic powder contains Fe in a proportion of 45.0 mass % or more and 52.0 mass % or less, Co in a proportion of 47.0 mass % or more and 52.0 mass % or less, V in a proportion of 0.030 mass % or more and less than 2.0 mass %, and Si in a proportion of 0.10 mass % or more, wherein the sum of the content of V and the content of Si is 2.5 mass % or less, and the soft magnetic powder has a specific surface area of 0.15 $m^2/g$ or more and 0.80 $m^2/g$ or less.

8 Claims, 3 Drawing Sheets

(56) References Cited

FOREIGN PATENT DOCUMENTS

| | | | | | |
|---|---|---|---|---|---|
| JP | S63-211604 | A | | 9/1988 | |
| JP | H01-119642 | A | | 5/1989 | |
| JP | H02-057608 | A | | 2/1990 | |
| JP | H03-153838 | A | | 7/1991 | |
| JP | H04-276002 | A | | 10/1992 | |
| JP | H06-158110 | A | | 6/1994 | |
| JP | H07-138712 | A | | 5/1995 | |
| JP | 2002-069503 | A | | 3/2002 | |
| JP | 2002231518 | A | * | 8/2002 | ..... H01F 1/33 |
| JP | 2006-336038 | A | | 12/2006 | |
| JP | 2008-248392 | A | | 10/2008 | |
| JP | 2008-258234 | A | | 10/2008 | |
| JP | 2013-204119 | A | | 10/2013 | |
| JP | 2013-204121 | A | | 10/2013 | |
| JP | 2016-222952 | A | | 12/2016 | |
| JP | 2017-048439 | A | | 3/2017 | |

OTHER PUBLICATIONS

Machine translation of CN 103357870A. (Year: 2013).*
Machine translation of JP 2002-231518A. (Year: 2002).*
Extended European Search Report for Patent Application No. EP19165453.2, dated Jul. 4, 2019 (8 pages).
Extended European Search Report for Patent Application No. EP19165452.4, dated Jul. 4, 2019 (8 pages).
U.S. Appl. No. 16/367,378, filed Mar. 28, 2019, Takayuki Murai.

* cited by examiner

SOFT MAGNETIC POWDER AND METHOD FOR PRODUCING SINTERED BODY

BACKGROUND

1. Technical Field

The present invention relates to a soft magnetic powder and a method for producing a sintered body.

2. Related Art

An Fe-based soft magnetic alloy containing Co has a high saturation magnetic flux density, and therefore is used for, for example, a component for an electromagnetic actuator.

For example, JP-A-7-138712 (Patent Document 1) discloses a sintered Fe—Co-based alloy containing Co at 40 to 60 wt %, V at 1 to 5 wt %, and Si at 0.5 to 3 wt %, with the remainder being Fe and unavoidable impurities, wherein the total amount of V and Si is 6 wt % or less. In such a sintered Fe—Co-based alloy, soft magnetic properties such as a magnetic flux density and AC magnetic properties are simultaneously achieved.

However, the sintered Fe—Co-based alloy described in Patent Document 1 has a problem that the workability is low. That is, the sintered Fe—Co-based alloy produced by powder metallurgy generally has a shape close to a desired shape immediately after sintering, however, additional processing is sometimes needed. However, when the workability of the sintered Fe—Co-based alloy is low, it is sometimes difficult to bring the shape thereof closer to the desired shape by machining. In such a case, it is difficult to make the sintered Fe—Co-based alloy into products as various types of magnetic components.

SUMMARY

An advantage of some aspects of the invention is to solve the above-mentioned problem and the invention can be implemented as the following application example.

A soft magnetic powder according to this application example contains Fe in a proportion of 45.0 mass % or more and 52.0 mass % or less, Co in a proportion of 47.0 mass % or more and 52.0 mass % or less, V in a proportion of 0.030 mass % or more and less than 2.0 mass %, and Si in a proportion of 0.10 mass % or more, wherein the sum of the content of V and the content of Si is 2.5 mass % or less, and the soft magnetic powder has a specific surface area of 0.15 $m^2/g$ or more and 0.80 $m^2/g$ or less.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
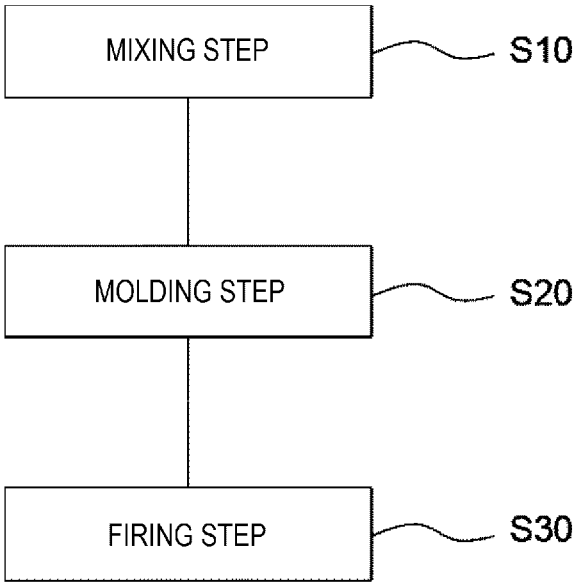
FIG. 1 is a process chart showing a method for producing a sintered body according to an embodiment.

Hereinafter, preferred embodiments of a soft magnetic powder and a method for producing a sintered body according to the invention will be described in detail with reference to the accompanying drawings. In the respective drawings, some portions are displayed by being appropriately enlarged or reduced in size and some portions are schematically shown so that portions to be described are in a recognizable state.

Soft Magnetic Powder

A soft magnetic powder according to an embodiment contains Fe in a proportion of 45.0 mass % or more and 52.0 mass % or less, Co in a proportion of 47.0 mass % or more and 52.0 mass % or less, V in a proportion of 0.030 mass % or more and less than 2.0 mass %, and Si in a proportion of 0.10 mass % or more, wherein the sum of the content of V and the content of Si is 2.5 mass % or less, and the soft magnetic powder has a specific surface area of 0.15 $m^2/g$ or more and 0.80 $m^2/g$ or less.

According to such a soft magnetic powder, a powder having a sufficiently high saturation magnetic flux density is obtained. When a sintered body produced using such a soft magnetic powder is used for, for example, generating an electromagnetic force necessary for electromagnetic drive such as a component for a dot impact printer (recording device) or a component for an electromagnetic actuator, a high driving force is generated without causing an increase in the size of the component. On the other hand, according to such a soft magnetic powder, a sintered body having high workability can be produced. Therefore, a sintered body having high dimensional accuracy and a favorable property of incorporating itself into a device is obtained.

Hereinafter, the alloy composition of the soft magnetic powder according to the embodiment will be described in more detail.

Fe (iron) has a great influence on the basic magnetic properties and mechanical properties of the soft magnetic powder.

The content of Fe is set to 45.0 mass % or more and 52.0 mass % or less, but is set to preferably 46.0 mass % or more and 51.0 mass % or less, more preferably 47.0 mass % or more and 50.5 mass % or less.

When the content of Fe is less than the above lower limit, the saturation magnetic flux density of the soft magnetic powder may be decreased or the mechanical properties of a sintered body may be deteriorated. On the other hand, when the content of Fe exceeds the above upper limit, the specific resistance of the soft magnetic powder may be decreased, the magnetic permeability may be decreased, or the coercivity may be increased.

Co (cobalt) mainly acts to increase the saturation magnetic flux density of the soft magnetic powder.

The content of Co is set to 47.0 mass % or more and 52.0 mass % or less, but is set to preferably 47.5 mass % or more and 51.5 mass % or less, more preferably 48.0 mass % or more and 50.0 mass % or less.

When the content of Co is less than the above lower limit, the specific resistance may be decreased, the coercivity may be increased, or the magnetic permeability may be decreased. On the other hand, when the content of Co exceeds the above upper limit, the saturation magnetic flux density of the soft magnetic powder may be decreased or the workability of a sintered body may be deteriorated.

V (vanadium) mainly acts to increase the specific resistance of the soft magnetic powder or to enhance the workability of a sintered body.

The content of V is set to 0.030 mass % or more and less than 2.0 mass %, but is set to preferably 0.20 mass % or more and 1.6 mass % or less, more preferably 0.40 mass % or more and 1.2 mass % or less.

When the content of V is less than the above lower limit, the specific resistance of the soft magnetic powder may be decreased or the workability of a sintered body may be deteriorated. On the other hand, when the content of V exceeds the above upper limit, the saturation magnetic flux density of the soft magnetic powder may be decreased.

Si (silicon) mainly acts to increase the specific resistance of the soft magnetic powder. On the other hand, the decrease in the saturation magnetic flux density due to the addition of Si can be minimized.

The content of Si is preferably 0.10 mass % or more, more preferably 0.20 mass % or more and 2.5 mass % or less, further more preferably 0.40 mass % or more and 1.5 mass % or less.

When the content of Si is less than the above lower limit, the specific resistance of the soft magnetic powder may not be able to be sufficiently increased depending on the overall composition. On the other hand, when the content of Si exceeds the above upper limit, the saturation magnetic flux density may be decreased or the workability of a sintered body may be deteriorated depending on the overall composition.

Further, the sum of the content of V and the content of Si is set to 2.5 mass % or less, but is set to preferably 0.30 mass % or more and 2.2 mass % or less, more preferably 0.50 mass % or more and 2.0 mass % or less. According to this, a decrease in the workability of a sintered body can be suppressed while increasing the saturation magnetic flux density.

When the sum of the content of V and the content of Si is less than the above lower limit, the specific resistance of the soft magnetic powder may be decreased or the workability of a sintered body may be deteriorated. On the other hand, when the sum of the content of V and the content of Si exceeds the above upper limit, the saturation magnetic flux density may be decreased.

The soft magnetic powder according to the embodiment may contain the following components as needed.

Cr (chromium) mainly acts to enhance the corrosion resistance of the soft magnetic powder.

The content of Cr is preferably 2.0 mass % or less, more preferably 0.10 mass % or more and 1.5 mass % or less, further more preferably 0.30 mass % or more and 1.2 mass % or less.

When the content of Cr is less than the above lower limit, the corrosion resistance of the soft magnetic powder may not be able to be sufficiently enhanced depending on the overall composition. On the other hand, when the content of Cr exceeds the above upper limit, the saturation magnetic flux density may be decreased depending on the overall composition.

Each of Ni (nickel) and Nb (niobium) mainly acts to enhance the mechanical properties of a sintered body.

The content of each of Ni and Nb is preferably 2.0 mass % or less, more preferably 0.10 mass % or more and 1.5 mass % or less, further more preferably 0.30 mass % or more and 1.2 mass % or less.

When the content of each of Ni and Nb is less than the above lower limit, the mechanical properties of a sintered body may not be able to be sufficiently enhanced depending on the overall composition. On the other hand, when the content of each of Ni and Nb exceeds the above upper limit, the saturation magnetic flux density may be decreased depending on the overall composition.

At least one of Mn (manganese), Al (aluminum), Mo (molybdenum), and W (tungsten) mainly acts to enhance the mechanical properties of a sintered body.

The content of Mn is preferably 1.0 mass % or less, more preferably 0.10 mass % or more and 0.80 mass % or less, further more preferably 0.30 mass % or more and 0.60 mass % or less.

The content of Al is preferably 2.0 mass % or less, more preferably 0.10 mass % or more and 1.6 mass % or less, further more preferably 0.30 mass % or more and 1.2 mass % or less.

The content of Mo is preferably 3.5 mass % or less, more preferably 0.10 mass % or more and 2.5 mass % or less, further more preferably 0.30 mass % or more and 2.0 mass % or less.

The content of W is preferably 1.0 mass % or less, more preferably 0.10 mass % or more and 0.80 mass % or less, further more preferably 0.30 mass % or more and 0.60 mass % or less.

When the content of each of Mn, Al, Mo, and W is less than the above lower limit, the mechanical properties of a sintered body may not be able to be sufficiently enhanced depending on the overall composition. On the other hand, when the content of each of Mn, Al, Mo, and W exceeds the above upper limit, the saturation magnetic flux density or the specific resistance may be decreased depending on the overall composition.

Hereinabove, the composition of the soft magnetic powder according to the invention is described in detail, however, this soft magnetic powder may contain any elements other than the above-mentioned elements. In such a case, the total content of the other elements is preferably 3.0 mass % or less, more preferably 2.0 mass % or less. Further, the content of each of the other elements is preferably 0.50 mass % or less, more preferably 0.30 mass % or less. When the content thereof is within such a range, the above-mentioned effects of the soft magnetic powder are not inhibited whether they are contained inevitably or intentionally, and therefore, the incorporation thereof is permitted.

The composition of the soft magnetic powder can be determined by, for example, Iron and steel—Atomic absorption spectrometric method specified in JIS G 1257 (2000), Iron and steel—ICP atomic emission spectrometric method specified in JIS G 1258 (2007), Iron and steel—Method for spark discharge atomic emission spectrometric analysis specified in JIS G 1253 (2002), Iron and steel—Method for X-ray fluorescence spectrometric analysis specified in JIS G 1256 (1997), gravimetry, titrimetry, and absorption spectroscopy specified in JIS G 1211 to G 1237, or the like. Specifically, for example, an optical emission spectrometer for solids (a spark emission spectrometer, model: Spectrolab, type: LAVMB08A) manufactured by SPECTRO Analytical Instruments GmbH or an ICP device (model: CIROS-120) manufactured by Rigaku Corporation is used.

Further, when C (carbon) and S (sulfur) are determined, particularly, an infrared absorption method after combustion in a stream of oxygen (after combustion in a high-frequency induction heating furnace) specified in JIS G 1211 (2011) is also used. Specifically, a carbon/sulfur analyzer, CS-200 manufactured by LECO Corporation is used.

Further, when N (nitrogen) and O (oxygen) are determined, particularly, Iron and steel—Method for determination of nitrogen content specified in JIS G 1228 (2006) and Method for determination of oxygen content in metallic materials specified in JIS Z 2613 (2006) are also used. Specifically, an oxygen/nitrogen analyzer TC-300/EF-300 manufactured by LECO Corporation is used.

As described above, the soft magnetic powder according to this embodiment is a powder containing Fe in a proportion of 45.0 mass % or more and 52.0 mass % or less, Co in a proportion of 47.0 mass % or more and 52.0 mass % or less, V in a proportion of 0.030 mass % or more and less than 2.0 mass %, and Si in a proportion of 0.10 mass % or more, wherein the sum of the content of V and the content of Si is 2.5 mass % or less, and the soft magnetic powder has a specific surface area of 0.15 $m^2/g$ or more and 0.80 $m^2/g$ or less.

Such a soft magnetic powder exhibits favorable flowability when it is molded into a desired shape and also exhibits favorable sinterability. Therefore, by using such a soft magnetic powder, a sintered body having a high sintered density, a high saturation magnetic flux density, and high mechanical properties can be produced. Further, by adding both V and Si and also optimizing the total addition amount thereof, the workability of a sintered body can be enhanced.

When such a sintered body is used for, for example, generating an electromagnetic force necessary for electromagnetic drive such as a component for a dot impact printer (recording device) or a component for an electromagnetic actuator, a high driving force is generated without causing an increase in the size of the component. In addition thereto, such a sintered body has high dimensional accuracy and a favorable property of incorporating itself into a device.

Further, by adding both V and Si, the soft magnetic powder according to this embodiment has a sufficiently high specific resistance. Due to this, a sintered body produced using such a soft magnetic powder also has a high specific resistance. Therefore, when such a sintered body is used for, for example, a component for a dot impact printer (recording device) or a component for an electromagnetic actuator, a component capable of suppressing the eddy current loss can be realized.

The specific surface area of the soft magnetic powder is preferably 0.20 $m^2/g$ or more and 0.70 $m^2/g$ or less, more preferably 0.30 $m^2/g$ or more and 0.60 $m^2/g$ or less.

The specific surface area of the soft magnetic powder is a value measured by a BET method and is measured using, for example, a BET specific surface area measurement device HM1201-010 manufactured by Mountech Co., Ltd. The amount of a sample is set to 5 g.

In the soft magnetic powder according to this embodiment, in a mass-based particle size distribution measured by a laser diffraction particle size distribution analyzer, when a particle diameter at a cumulative frequency from a small diameter side of 10% is represented by D10, a particle diameter at a cumulative frequency of 50% is represented by D50, and a particle diameter at a cumulative frequency of 90% is represented by D90, (D90−D10)/D50 which is also called "span" preferably satisfies 1.0 or more and 3.5 or less, more preferably satisfies 1.2 or more and 3.0 or less, further more preferably satisfies 1.5 or more and 2.5 or less.

Such a soft magnetic powder exhibits favorable flowability when it is molded into a desired shape. That is, such a soft magnetic powder is favorably packed into every corner when it is packed in a molding die and molded. Therefore, the molded density can be increased, and also a sintered body having a high sintered density is obtained. Such a sintered body has a high saturation magnetic flux density.

When (D90−D10)/D50 is less than the above lower limit, the width of the particle size distribution becomes relatively large although it varies depending on the composition of the soft magnetic powder, and therefore, the packing density is decreased, and the saturation magnetic flux density of a sintered body may not be able to be sufficiently increased. On the other hand, when (D90−D10)/D50 exceeds the above upper limit, the flowability of the soft magnetic powder is deteriorated although it varies depending on the composition of the soft magnetic powder, and therefore, the sintered density is decreased, and the saturation magnetic flux density of a sintered body may not be able to be sufficiently increased.

Further, when the above-mentioned D50 is defined as the average particle diameter of the soft magnetic powder, the average particle diameter D50 of the soft magnetic powder is preferably 0.50 μm or more and 50.0 μm or less, more preferably 1.0 μm or more and 30.0 μm or less, further more preferably 3.0 μm or more and 20.0 μm or less. By using the soft magnetic powder having such an average particle diameter D50, a sintered body which is dense and has a high saturation magnetic flux density and also high mechanical properties is obtained.

When the average particle diameter D50 of the soft magnetic powder is less than the above lower limit, the soft magnetic powder is too fine, and therefore, the packing property of the soft magnetic powder may be easily deteriorated. Due to this, the sintered density of a sintered body is decreased, and the saturation magnetic flux density or the magnetic permeability may be decreased. On the other hand, when the average particle diameter D50 of the soft magnetic powder exceeds the above upper limit, the flowability of the soft magnetic powder is deteriorated, and therefore, the sintered density is decreased, and the saturation magnetic flux density or the magnetic permeability may not be able to be sufficiently increased likewise.

The particle size distribution of the soft magnetic powder may be any distribution, and the number of peaks in the particle size distribution may be one or more than one.

The tap density of the soft magnetic powder slightly varies depending on the particle diameter or the alloy composition, and therefore is not particularly limited, but is preferably 3.6 $g/cm^3$ or more and 5.5 $g/cm^3$ or less, more preferably 3.8 $g/cm^3$ or more and 5.2 $g/cm^3$ or less. The soft magnetic powder having such a tap density exhibits a favorable packing property when it is molded. Therefore, a sintered body having a high sintered density, a high saturation magnetic flux density, and high mechanical properties can be obtained.

The tap density of the soft magnetic powder is measured in accordance with the method for measuring the tap density of metallic powders specified in JIS Z 2512:2012, and the unit is, for example, [$g/cm^3$].

Such a soft magnetic powder may be produced by any method, but is produced by, for example, various atomization methods such as a water atomization method, a gas atomization method, and a spinning water atomization method, a reducing method, a carbonyl method, a pulverization method, or the like. Among these, as the soft magnetic powder, a powder produced by an atomization method is preferably used. That is, the soft magnetic powder is preferably an atomized powder. According to this, a sintered body having a high sintered density, a high saturation magnetic flux density, and high mechanical properties is obtained.

The metal powder produced by an atomization method has a spherical shape relatively close to a perfect sphere, and therefore has excellent dispersibility and flowability in an organic binder. Therefore, from this viewpoint, the sintered density is increased.

In the water atomization method, a molten raw material is caused to collide with jets of cooling water so as to atomize the raw material into a fine powder, whereby a metal powder is produced.

At this time, when the melting point of the raw material is denoted by Tm, the temperature of the molten raw material is set to preferably Tm+20° C. or higher and Tm+200° C. or lower, more preferably Tm+50° C. or higher and Tm+150° C. or lower. According to this, the particle size distribution such as the average particle diameter or the span is optimized, and also the powder properties such as the specific surface area can be optimized. Therefore, the above-mentioned soft magnetic powder can be efficiently produced.

When the melting temperature is increased, the average particle diameter tends to decrease or the specific surface area tends to increase. On the other hand, when the melting temperature is decreased, the average particle diameter tends to increase or the specific surface area tends to decrease.

The pressure of the cooling water is not particularly limited, but is set to preferably 50 MPa or more and 200 MPa or less, more preferably 70 MPa or more and 150 MPa or less. According to this, the particle size distribution is optimized, and also the powder properties such as the tap density can be optimized. Therefore, the above-mentioned soft magnetic powder can be efficiently produced.

When the pressure of the cooling water is increased, the average particle diameter tends to decrease or the tap density tends to decrease. On the other hand, when the pressure of the cooling water is decreased, the average particle diameter tends to increase or the tap density tends to increase.

The thus obtained soft magnetic powder may be classified as needed. Examples of the classification method include dry classification such as sieve classification, inertial classification, centrifugal classification, and wind power classification, and wet classification such as sedimentation classification. By such classification, the particle size distribution such as the average particle diameter or the span, the specific surface area, the tap density, or the like can be appropriately adjusted.

Sintered Body

Next, a sintered body produced using the soft magnetic powder according to the embodiment will be described.

This sintered body is a sintered body obtained by firing the above-mentioned soft magnetic powder. Such a sintered body has a high saturation magnetic flux density and also a high specific resistance.

The saturation magnetic flux density of the sintered body is preferably 2.2 T or more, more preferably 2.3 T or more, further more preferably 2.4 T or more. When such a sintered body is used for, for example, a component for a dot impact printer (recording device) or a component for an electromagnetic actuator, a high driving force is generated without causing an increase in the size of the component. Therefore, the performance of a device including such a component can be enhanced.

The saturation magnetic flux density of the sintered body is measured using, for example, a vibrating sample magnetometer (VSM).

The specific resistance of the sintered body is preferably 20 μΩcm or more, more preferably 22 μΩcm or more and 200 μΩcm or less, further more preferably 25 μΩcm or more and 150 μΩcm or less. Such a sintered body can suppress the eddy current loss small when an electromagnetic force is generated. Therefore, a decrease in the electromagnetic force due to eddy current loss can be suppressed.

The specific resistance of the sintered body is determined as a volume resistivity using, for example, a resistivity meter or the like adopting a four-terminal method.

The surface Vickers hardness of the sintered body is preferably 300 or more and 400 or less, more preferably 320 or more and 380 or less. Such a sintered body has high rigidity, and therefore has high durability over a long period of time. That is, in a case in which the sintered body is applied to a yoke case 1, for example, when a winding wire is wound around a core 12, deformation of the core 12 is suppressed, and a favorable electromagnetic force can be generated over a long period of time.

When the Vickers hardness is less than the above lower limit, the yoke case 1 may be easily deformed. On the other hand, when the Vickers hardness exceeds the above upper limit, the toughness of the yoke case 1 may be deteriorated.

The Vickers hardness of the sintered body is measured, for example, in accordance with the Vickers hardness test method specified in JIS Z 2244 (2009).

The sintered body produced from the soft magnetic powder as described above may be used for any application. Examples of such application include a component for a dot impact printer (recording device), a component for an electromagnetic actuator, a component for a magnetic head, a component for a solenoid valve, a component for an electric motor, a component for a power generator, a component for a magnetostrictive sensor, a component for a speaker, a component for an electron microscope, and a component for a high magnetic field electromagnet.

Method for Producing Sintered Body

Next, a method for producing a sintered body according to an embodiment will be described.

FIG. 1 is a process chart showing the method for producing a sintered body according to the embodiment.

The method for producing a sintered body shown in FIG. 1 includes a mixing step of mixing the soft magnetic powder according to the embodiment and an organic binder, thereby obtaining a mixture, a molding step of molding the mixture, thereby obtaining a molded body, and a firing step of firing the molded body, thereby obtaining a sintered body. Hereinafter, the respective steps will be sequentially described.

Mixing Step S10

First, the soft magnetic powder and an organic binder are mixed, thereby obtaining a mixture. Examples of the mixture include a kneaded material (compound) obtained by kneading the soft magnetic powder and an organic binder and a granulated powder obtained by granulating a slurry containing the soft magnetic powder and an organic binder.

In the preparation of the kneaded material, for example, various types of kneaders such as a pressure or double-arm kneader-type mixer, a roll-type kneader, a Banbury-type kneader, and a single-screw or twin-screw extruder can be used.

In the preparation of the granulated powder, for example, a spray dryer, a tumbling granulator, a tumbling fluidized bed granulator, or the like can be used.

The organic binder preferably contains an unsaturated glycidyl group-containing polymer. The unsaturated glycidyl group-containing polymer is a polymer containing an unsaturated glycidyl group-containing monomer as a repeating unit. Examples of the unsaturated glycidyl group-containing monomer include glycidyl (meth)acrylate, allyl glycidyl ether, α-ethyl glycidyl ether, crotonyl glycidyl ether, glycidyl crotonate, monoalkyl itaconate monoglycidyl ester, monoalkyl fumarate monoglycidyl ester, monoalkyl maleate monoglycidyl ester, and alicyclic epoxy group-containing (meth)acrylate, and the organic binder contains one type or two or more types among these. Further, glycidyl (meth) acrylate is particularly preferably used.

Examples of a component to be contained in the organic binder include, other than the unsaturated glycidyl group-containing polymer, various types of resins including polyolefins such as polyethylene, polypropylene, polybutylene, and polypentene, polyolefin-based copolymers such as polyethylene-polypropylene copolymers and polyethylene-polybutylene copolymers, styrenic resins such as polystyrene, acrylic resins such as poly(methyl methacrylate) and poly (butyl methacrylate), polyvinyl chloride, polyvinylidene chloride, polyamide, polyesters such as polyethylene terephthalate and polybutylene terephthalate, polyether, polyvinyl alcohol, polyacetal, or copolymers thereof and the like, various types of waxes, higher fatty acids (for example, stearic acid), higher alcohols, higher fatty acid esters, higher fatty acid amides, and phthalate esters, and among these, one type or two or more types are used.

Among these, the organic binder preferably contains an unsaturated glycidyl group-containing polymer, a styrenic resin, a wax, and a phthalate ester. According to a combination of these components, a sintered body having a particularly high saturation magnetic flux density and particularly excellent mechanical properties can be produced.

Examples of the styrenic resin include polymers and copolymers containing a styrene monomer as a repeating unit, and polystyrene that is a homopolymer is preferably used.

As the wax, a petroleum-based wax or a modified wax thereof is preferably used, and paraffin wax, microcrystalline wax, carnauba wax, or a derivative thereof is more preferably used, and paraffin wax or carnauba wax is further more preferably used.

Examples of the phthalate ester include dimethyl phthalate, diethyl phthalate, butyl phthalate, dibutyl phthalate, diisobutyl phthalate, and dioctyl phthalate, and among these, one type or a combination of two types is used.

The mixture may contain, other than the above-mentioned components, another additive, for example, an antioxidant, a degreasing accelerator, a surfactant, or the like.

The content of the organic binder in the mixture is preferably 3 parts by mass or more and 9 parts by mass or less, more preferably 4 parts by mass or more and 9 parts by mass or less, further more preferably 5 parts by mass or more and 8 parts by mass or less with respect to 100 parts by mass of the soft magnet powder.

Molding Step S20

Subsequently, the obtained kneaded material is molded. By doing this, a molded body having a desired shape and size is produced.

As the molding method, for example, an injection molding method, a compression molding method, an extrusion molding method, or the like is used. The shape and size of the molded body to be produced are determined in anticipation of shrinkage by the subsequent degreasing and sintering.

The thus obtained molded body may be subjected to post-processing such as machining or laser processing as needed.

In addition, the obtained molded body may be subjected to a degreasing process. By doing this, a part or the whole of the organic binder contained in the molded body can be removed (degreased).

The molded body after degreasing may also be subjected to post-processing as needed.

Firing Step S30

Subsequently, the obtained molded body is fired. By doing this, the soft magnetic powder is sintered, and a sintered body is obtained.

The firing temperature of the molded body is not particularly limited, but is preferably 1050° C. or higher and 1600° C. or lower, more preferably 1050° C. or higher and 1400° C. or lower.

The firing time of the molded body is not particularly limited, but is preferably 1 hour or more and 25 hours or less, more preferably 2 hours or more and 20 hours or less.

The firing atmosphere is not particularly limited, but is preferably an inert gas atmosphere or a reduced pressure atmosphere, more preferably a reduced pressure inert gas atmosphere. According to this, while suppressing oxidation or denaturation of the soft magnetic powder, the decomposed component of the organic binder can be efficiently discharged by performing gas exchange around the molded body and vacuum evacuation.

It is expected that the relative density of the sintered body to be obtained is preferably 95% or more, more preferably 96% or more. Such a sintered body has a high sintered density, a high saturation magnetic flux density, and excellent mechanical properties.

Further, the obtained sintered body may be subjected to various types of post-processing, for example, machining such as cutting, pressing, or polishing, electric discharge processing, laser processing, etching, etc. By performing such post-processing, deburring can be performed, or the dimensional accuracy can be further improved.

Further, the obtained sintered body may be subjected to a HIP process (hot isostatic pressing process) or the like as needed. By doing this, the density of the sintered body can be further increased.

The conditions for the HIP process are set, for example, as follows: the temperature is 850° C. or higher and 1100° C. or lower, and the time is 1 hour or more and 10 hours or less.

The applied pressure is preferably 50 MPa or more, more preferably 100 MPa or more.

As described above, the method for producing a sintered body according to the embodiment includes a mixing step of mixing the soft magnetic powder according to the above-mentioned embodiment and an organic binder, thereby obtaining a mixture, a molding step of molding the mixture, thereby obtaining a molded body, and a firing step of firing the molded body, thereby obtaining a sintered body.

According to such a method for producing a sintered body, a sintered body having a high saturation magnetic flux density and a high specific resistance can be produced.

Yoke Case

Next, a yoke case will be described as an application example of the sintered body.

Figure 2:
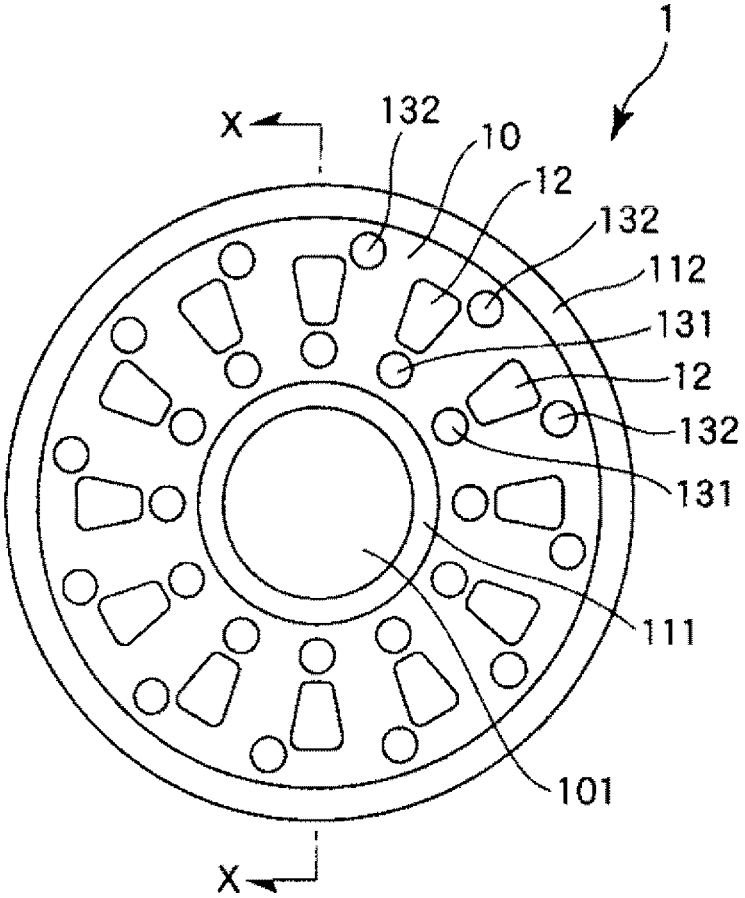
FIG. 2 is a plan view showing a yoke case that is an application example of a sintered body produced using a soft magnetic powder according to an embodiment.
Figure 3:
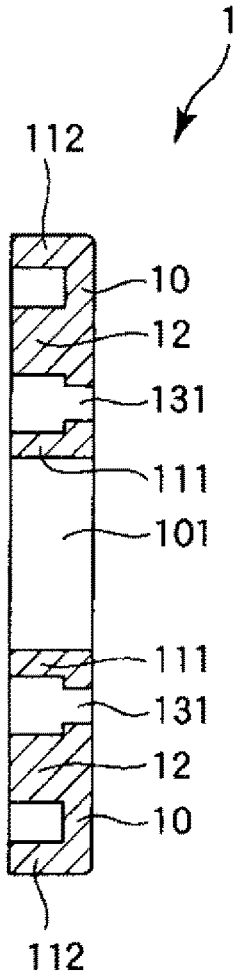
FIG. 3 is a cross-sectional view taken along the line X-X of FIG. 2.

FIG. 2 is a plan view showing a yoke case that is an application example of the sintered body produced using the soft magnetic powder according to the embodiment. FIG. 3 is a cross-sectional view taken along the line X-X of FIG. 2. In the following description, for the sake of convenience of explanation, a description will be given by referring to the left side and the right side in FIG. 3 as "upper" and "lower", respectively.

A yoke case 1 shown in FIG. 2 is an annular plate-shaped member. In the yoke case 1, a round central hole 101 penetrates through a central portion in a plan view. The "plan view" in the yoke case 1 refers to a plan view from the thickness direction of the yoke case 1.

The yoke case 1 has a recessed shape opened to the upper side. What corresponds to the bottom of this recessed portion is a case body 10. On an inner edge (an edge on the central hole 101 side) of the case body 10, an edge portion 111 protruding upward is provided, and on an outer edge (an edge on the opposite side to the central hole 101) of the case body 10, an edge portion 112 protruding upward is provided. That is, the yoke case 1 includes the case body 10 corresponding to the bottom of the recessed shape, and the edge portion 111 and the edge portion 112 corresponding to the side walls of the recessed shape.

Further, the yoke case 1 includes a core 12 that is provided in a region between the edge portion 111 and the edge portion 112 of the case body 10 in a plan view and protrudes upward. This core 12 is spaced apart from the edge portions 111 and 112 in a plan view. The protruding height of the core 12 is the same as the protruding heights of the edge portions 111 and 112.

The yoke case 1 includes twelve cores 12. At this time, when a straight line connecting each core 12 to the center of the central hole 101 is drawn, the separation angle between adjacent cores is equal in the whole yoke case 1. That is, a figure obtained by arranging the cores 12 forms a shape that satisfies a 12-fold rotational symmetry with the center of the central hole 101 as the axis of rotation.

On the other hand, the yoke case 1 includes through-holes 131 and 132 that are provided in a region between the edge portion 111 and the edge portion 112 of the case body 10 in a plan view and penetrate through the case body 10 in the thickness direction. Each of these through-holes 131 and 132 is spaced apart from the edge portions 111 and 112 and the cores 12 in a plan view.

The yoke case 1 includes twelve through-holes 131. These through-holes 131 are provided between the cores 12 and the edge portion 111 in a plan view.

Similarly, the yoke case 1 includes twelve through-holes 132. These through-holes 132 are provided between the cores 12 and the edge portion 112 in a plan view.

A figure obtained by arranging these through-holes 131 or 132 also forms a shape that satisfies a 12-fold rotational symmetry with the center of the central hole 101 as the axis of rotation.

Such a yoke case 1 includes the sintered body of the soft magnetic powder according to the embodiment described above. According to this, the yoke case 1 has soft magnetic properties. Then, by winding a winding wire (not shown) around each core 12, an electromagnetic coil is formed. Therefore, by allowing an electric current to flow through the winding wire, a component including the yoke case 1 can generate an electromagnetic force for operating as an electromagnetic actuator.

As described above, the sintered body of the soft magnetic powder according to the embodiment has a high saturation magnetic flux density and also a high specific resistance. Therefore, also the yoke case 1 and the core 12 included in the yoke case 1 have a high saturation magnetic flux density and a high specific resistance. As a result, in the electromagnetic actuator including the yoke case 1, a high driving force is generated without causing an increase in the size of the component, and also the eddy current loss is suppressed, and a decrease in the driving force due to the eddy current loss is suppressed. Therefore, in a device including the electromagnetic actuator, the output can be enhanced while avoiding an increase in the size.

Dot Impact Printer

Next, a dot impact printer (recording device) including the yoke case will be described.

Figure 4:
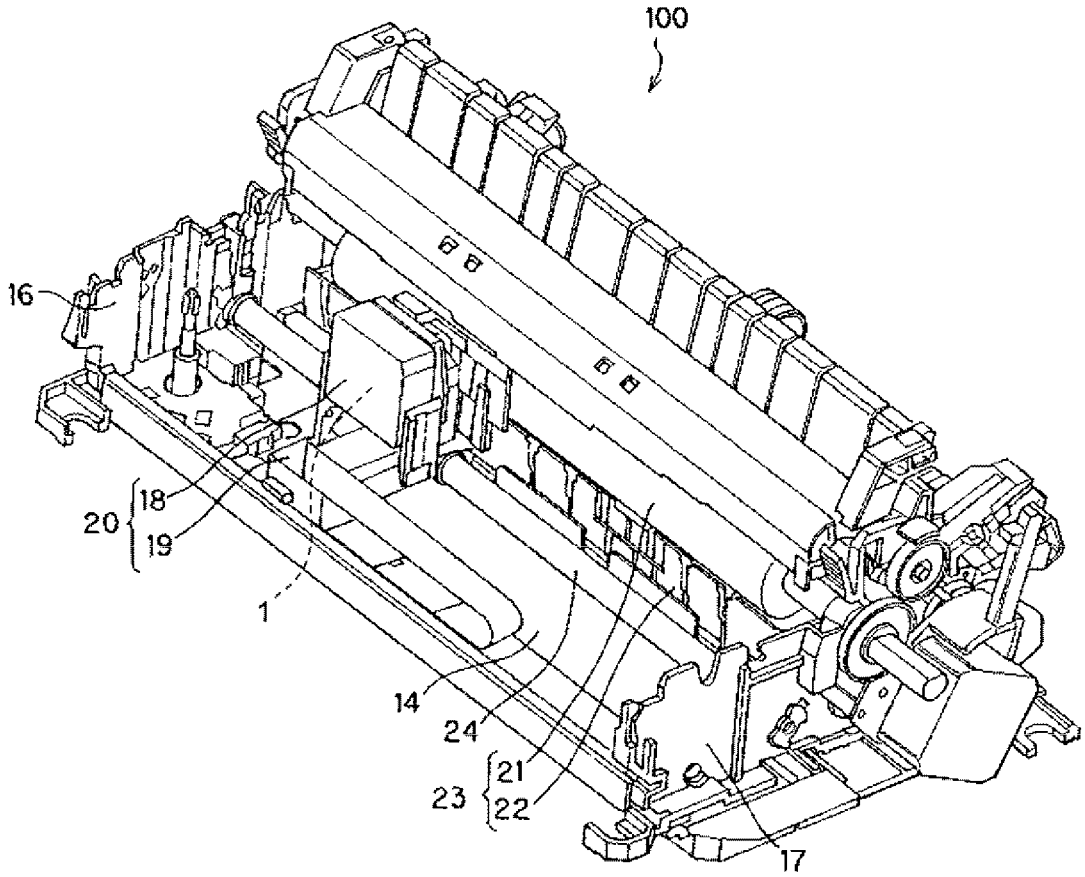
FIG. 4 is a perspective view showing a dot impact printer including the yoke case shown in FIG. 2.

FIG. 4 is a perspective view showing a dot impact printer including the yoke case shown in FIG. 2. In FIG. 4, for the sake of convenience of explanation, only the interior of the printer in a state where the exterior is detached is shown. Further, in the following description, the dot impact printer is also shortened and simply referred to as "printer".

A printer 100 shown in FIG. 4 is a dot impact printer configured to print letters or images by impacting a recording wire (not shown) included in a recording head 18 against a material to be printed such as a sheet through an ink ribbon (not shown) so as to record dots.

The printer 100 shown in FIG. 4 has a base frame 14 as a main body frame, a left side frame 16, a right side frame 17, a printing mechanism portion 20 including a recording head 18 and a carriage 19, and a sheet conveying mechanism portion 23 including a platen 21 and a sheet guide 22.

The left side frame 16 and the right side frame 17 are erected on both ends of the base frame 14, respectively. Between the left side frame 16 and the right side frame 17, a carriage shaft 24 is stretched and pivotally supported, and the platen 21 is stretched and rotatably disposed as shown in FIG. 4.

The sheet guide 22 is disposed between the left side frame 16 and the right side frame 17, and a sheet is conveyed between the sheet guide 22 and the platen 21.

Here, the recording head 18 includes the above-mentioned yoke case 1. Around the cores 12 (see FIG. 3) of the yoke case 1, a winding wire (not shown) is wound, and by allowing an electric current to flow through the winding wire, a recording wire included in the recording head 18 is driven. That is, the recording head 18 functions as an electromagnetic actuator that drives the recording wire by an electromagnetic force.

As described above, the yoke case 1 includes the sintered body of the soft magnetic powder according to the embodiment, and therefore has a high saturation magnetic flux density and a high specific resistance. As a result, in the recording head 18 including the yoke case 1, a high driving force is generated without causing an increase in the size of the component, and also the eddy current loss is suppressed, and a decrease in the driving force due to the eddy current loss is suppressed. Therefore, in the printer 100, the output can be enhanced while avoiding an increase in the size.

Hereinabove, the invention is described based on preferred embodiments, however, the invention is not limited thereto.

For example, the shape of the yoke case is not limited to the shape shown in the drawing, and may be any shape. For example, the number of cores is not limited to 12, and may be smaller or larger than 12. Further, the number of through-holes may be increased or decreased according to the number of cores.

EXAMPLES

Next, specific Examples of the invention will be described.

1. Production of Sintered Body

Sample No. 1

First, a soft magnetic powder having a composition shown in Table 1 produced by a water atomization method was prepared. With respect to this soft magnetic powder, the average particle diameter was measured using a laser diffraction particle size distribution analyzer (Microtrack HRA9320-X100, manufactured by Nikkiso Co., Ltd.). The measurement result is shown in Table 1.

Subsequently, an unsaturated glycidyl group-containing polymer, a styrenic resin, and paraffin wax were each frozen and ground, whereby a binder powder was obtained.

Subsequently, the soft magnetic powder, the binder powder, and a phthalate ester were mixed and kneaded at a kneading temperature of 160° C. for 30 minutes using a pressure kneader. This kneading was performed in a nitrogen gas atmosphere.

Subsequently, the obtained kneaded material was crushed using a pelletizer, whereby pellets having an average particle diameter of 5 mm were obtained.

Subsequently, by using the obtained pellets, molding was performed using an injection molding machine under the following molding conditions: material temperature: 190° C., and injection pressure: 10.8 MP (110 kgf/cm$^2$). By doing this, a molded body was obtained.

Subsequently, the obtained molded body was subjected to a degreasing process by heating at 475° C. for 5 hours in a nitrogen atmosphere. By doing this, a degreased body was obtained.

Subsequently, the obtained degreased body was subjected to a firing process by heating at 1100° C. for 8 hours in an argon atmosphere. By doing this, a sintered body was obtained.

The obtained sintered body was an annular plate-shaped body (yoke case) as shown in FIG. 2, and had an outer diameter of 35 mm, an inner diameter of 10 mm, and a maximum thickness of 5 mm.

The respective components of the organic binder are as follows.

Unsaturated Glycidyl Group-Containing Polymer

E-GMA-VA Copolymer

In the above notation, E denotes a repeating unit containing ethylene, GMA denotes a repeating unit containing glycidyl methacrylate, and VA denotes a repeating unit containing vinyl acetate.

Styrenic Resin polystyrene (weight-average molecular weight: 10000)

Wax paraffin wax

Phthalate Ester dibutyl phthalate

Sample Nos. 2 to 20

Sintered bodies were obtained in the same manner as in Example 1 except that the production conditions were changed as shown in Table 1, respectively.

In Table 1, those corresponding to the invention are denoted by "Example", and those not corresponding to the invention are denoted by "Comp. Ex." (Comparative Example).

2. Evaluation of Sintered Body 2.1 Evaluation of Sintered Density

With respect to the sintered bodies obtained in the respective Examples and Comparative Examples, the density was measured by a method in accordance with the Archimedes' method (specified in JIS Z 2501). Then, the relative density of the sintered body was calculated from the measured sintered density and the true density of the soft magnetic powder.

Then, the calculated relative density was evaluated in the light of the following evaluation criteria.

Evaluation Criteria for Relative Density

A: The relative density is 98.0% or more.

B: The relative density is 97.5% or more and less than 98.0%.

C: The relative density is 97.0% or more and less than 97.5%.

D: The relative density is 96.5% or more and less than 97.0%.

E: The relative density is 96.0% or more and less than 96.5%.

F: The relative density is less than 96.0%.

The evaluation results are shown in Table 1.

2.2 Evaluation of Saturation Magnetic Flux Density

With respect to the sintered bodies obtained in the respective Examples and Comparative Examples, the saturation magnetic flux density was measured using a vibrating sample magnetometer.

Then, the measured saturation magnetic flux density was evaluated in the light of the following evaluation criteria.

Evaluation Criteria for Saturation Magnetic Flux Density

A: The saturation magnetic flux density is 2.4 T or more.

B: The saturation magnetic flux density is 2.3 T or more and less than 2.4 T.

C: The saturation magnetic flux density is 2.2 T or more and less than 2.3 T.

D: The saturation magnetic flux density is 2.1 T or more and less than 2.2 T.

E: The saturation magnetic flux density is 2.0 T or more and less than 2.1 T.

F: The saturation magnetic flux density is less than 2.0 T.

The evaluation results are shown in Table 1.

2.3 Evaluation of Specific Resistance

With respect to the sintered bodies obtained in the respective Examples and Comparative Examples, the volume resistivity was measured by a four-terminal method.

Then, the measured volume resistivity was evaluated in the light of the following evaluation criteria.

Evaluation Criteria for Volume Resistivity

A: The volume resistivity is 25 μΩcm or more.

B: The volume resistivity is 23 μΩcm or more and less than 25 μΩcm.

C: The volume resistivity is 21 μΩcm or more and less than 23 μΩcm.

D: The volume resistivity is 19 μΩcm or more and less than 21 μΩcm.

E: The volume resistivity is 17 μΩcm or more and less than 19 μΩcm.

F: The volume resistivity is less than 17 μΩcm.

The evaluation results are shown in Table 1.

2.4 Evaluation of Workability Based on Cutting Resistance

With respect to the sintered bodies obtained in the respective Examples and Comparative Examples, the cutting resistance was evaluated as follows.

First, the obtained sintered body was fixed to a measuring portion of a three-component cutting dynamometer.

Subsequently, the sintered body was subjected to cutting on a machining center so as to be scanned by a machining tool. Then, among the cutting resistances of the three components measured during the cutting, the maximum value was obtained and evaluated according to the following evaluation criteria.

Evaluation Criteria for Cutting Resistance

A: The cutting resistance is 150 N or less.

B: The cutting resistance is more than 150 N and 200 N or less.

C: The cutting resistance is more than 200 N and 250 N or less.

D: The cutting resistance is more than 250 N and 300 N or less.

E: The cutting resistance is more than 300 N.

The evaluation results are shown in Table 1.

2.5 Evaluation of Surface Hardness

With respect to the sintered bodies obtained in the respective Examples and Comparative Examples, the surface hardness was measured.

Then, the measured surface hardness was evaluated in the light of the following evaluation criteria.

Evaluation Criteria for Surface Hardness

A: The Vickers hardness is 320 or more and 380 or less.

B: The Vickers hardness is 300 or more and less than 320 or more than 380 and 400 or less.

C: The Vickers hardness is less than 300 or more than 400.

The evaluation results are shown in Table 1.

TABLE 1

| | | Production conditions for soft magnetic powder | | | | | | | | | |
|---|---|---|---|---|---|---|---|---|---|---|---|
| | | | | | | | | Powder properties | | | |
| | | Alloy composition | | | | | | | (D90 − D10)/ | Specific surfaces | Tap |
| | | Co mass % | V mass % | Si mass % | Cr mass % | Fe mass % | V + Si mass % | D50 μm | D50 — | area $m^2/g$ | density $g/cm^3$ |
| No. 1 | Example | 49.2 | 0.1 | 0.1 | | 50.6 | 0.2 | 5.1 | 2.6 | 0.75 | 3.6 |
| No. 2 | Example | 49.1 | 0.3 | 0.2 | | 50.4 | 0.5 | 6.5 | 2.0 | 0.63 | 4.1 |
| No. 3 | Example | 49.0 | 0.4 | 0.3 | | 50.3 | 0.7 | 9.2 | 2.2 | 0.32 | 4.8 |
| No. 4 | Example | 48.9 | 0.5 | 0.5 | | 50.1 | 1.0 | 8.1 | 2.1 | 0.36 | 4.4 |
| No. 5 | Example | 49.1 | 0.7 | 0.5 | | 49.7 | 1.2 | 7.8 | 2.0 | 0.44 | 4.3 |
| No. 6 | Example | 49.2 | 1.1 | 0.5 | | 49.2 | 1.6 | 8.7 | 2.4 | 0.32 | 4.7 |
| No. 7 | Example | 49.0 | 1.4 | 0.5 | | 49.1 | 1.9 | 11.8 | 2.6 | 0.17 | 5.4 |
| No. 8 | Example | 48.7 | 0.5 | 1.5 | | 49.3 | 2.0 | 8.0 | 1.9 | 0.40 | 4.4 |
| No. 9 | Example | 49.0 | 1.0 | 1.0 | | 49.0 | 2.0 | 9.6 | 2.3 | 0.30 | 5.0 |
| No. 10 | Example | 49.2 | 1.5 | 0.5 | | 48.8 | 2.0 | 10.5 | 2.1 | 0.22 | 5.1 |
| No. 11 | Example | 49.5 | 0.5 | 0.5 | 0.5 | 49.5 | 1.0 | 3.2 | 3.2 | 0.67 | 4.0 |
| No. 12 | Example | 49.1 | 0.7 | 0.5 | 1.0 | 49.7 | 1.2 | 4.2 | 2.8 | 0.63 | 4.3 |
| No. 13 | Example | 47.8 | 0.5 | 0.5 | | 51.2 | 1.0 | 12.5 | 1.4 | 0.16 | 5.3 |
| No. 14 | Example | 50.5 | 1.0 | 0.5 | | 48.0 | 1.5 | 16.7 | 1.1 | 0.15 | 5.6 |
| No. 15 | Comparative Example | 50.0 | 0.0 | 0.0 | | 50.0 | 0.0 | 8.5 | 2.0 | 0.34 | 4.6 |
| No. 16 | Comparative Example | 49.3 | 1.0 | 0.0 | | 49.7 | 1.0 | 22.0 | 0.9 | 0.12 | 5.6 |
| No. 17 | Comparative Example | 49.0 | 0.0 | 0.5 | | 50.5 | 0.5 | 6.3 | 2.1 | 0.64 | 4.0 |
| No. 18 | Comparative Example | 49.2 | 0.5 | 3.0 | | 47.3 | 3.5 | 11.0 | 1.5 | 0.18 | 5.3 |
| No. 19 | Comparative Example | 49.5 | 0.7 | 0.5 | | 49.3 | 1.2 | 5.5 | 3.8 | 0.83 | 3.3 |
| No. 20 | Comparative Example | 49.0 | 2.0 | 0.7 | | 48.3 | 2.7 | 16.0 | 1.2 | 0.14 | 5.5 |

| | | Evaluation results of sintered body | | | | |
|---|---|---|---|---|---|---|
| | | Sintered density — | Saturation magnetic flux density — | Specific resistance — | Workability — | Surface hardness — |
| No. 1 | Example | C | A | C | C | C |
| No. 2 | Example | A | A | B | B | A |
| No. 3 | Example | A | A | B | B | A |
| No. 4 | Example | A | A | A | A | A |
| No. 5 | Example | A | A | A | A | A |
| No. 6 | Example | A | A | A | B | A |
| No. 7 | Example | B | B | A | B | A |
| No. 8 | Example | A | A | A | B | B |
| No. 9 | Example | A | A | A | A | B |
| No. 10 | Example | A | A | A | A | A |
| No. 11 | Example | A | B | A | C | A |
| No. 12 | Example | A | B | A | C | A |
| No. 13 | Example | B | A | C | C | A |
| No. 14 | Example | C | C | B | B | A |
| No. 15 | Comparative Example | B | A | E | E | C |
| No. 16 | Comparative Example | C | D | B | A | A |
| No. 17 | Comparative Example | B | D | A | C | C |
| No. 18 | Comparative Example | A | F | A | E | C |
| No. 19 | Comparative Example | C | D | A | B | B |
| No. 20 | Comparative Example | D | E | A | D | B |

As apparent from Table 1, it was confirmed that the sintered bodies obtained in the respective Examples all have a high saturation magnetic flux density and high workability.

The entire disclosure of Japanese Patent Application No. 2018-064792 filed Mar. 29, 2018 is expressly incorporated herein by reference.

What is claimed is:

1. A soft magnetic powder, comprising:

Fe in a proportion of 45.0 mass % or more and 52.0 mass % or less;

Co in a proportion of 47.0 mass % or more and 52.0 mass % or less;

V in a proportion of 0.030 mass % or more and less than 0.7 mass %;

Si in a proportion of 0.10 mass % or more; and

Nb in an amount of 0.1 mass % or more and 1.5 mass % or less, wherein the sum of the content of V and the content of Si is 2.5 mass % or less, and the soft magnetic powder has a specific surface area of 0.15 $m^2/g$ or more and 0.80 $m^2/g$ or less.

2. The soft magnetic powder according to claim 1, wherein in a mass-based particle size distribution measured by a laser diffraction particle size distribution analyzer, when a particle diameter at a cumulative frequency from a small diameter side of 10% is represented by D10, a particle diameter at a cumulative frequency of 50% is represented by D50, and a particle diameter at a cumulative frequency of 90% is represented by D90, (D90-D10)/D50 satisfies 1.0 or more and 3.5 or less.

3. The soft magnetic powder according to claim 1, wherein the soft magnetic powder is an atomized powder.

4. The soft magnetic powder according to claim 1, wherein the soft magnetic powder has a tap density of 3.6 $g/cm^3$ or more and 5.5 $g/cm^3$ or less.

5. A method for producing a sintered body, comprising:

mixing the soft magnetic powder according to claim 1 and an organic binder, thereby obtaining a mixture;

molding the mixture, thereby obtaining a molded body; and firing the molded body, thereby obtaining a sintered body.

6. A method for producing a sintered body, comprising:

mixing the soft magnetic powder according to claim 2 and an organic binder, thereby obtaining a mixture;

molding the mixture, thereby obtaining a molded body; and firing the molded body, thereby obtaining a sintered body.

7. A method for producing a sintered body, comprising:

mixing the soft magnetic powder according to claim 3 and an organic binder, thereby obtaining a mixture;

molding the mixture, thereby obtaining a molded body; and firing the molded body, thereby obtaining a sintered body.

8. A method for producing a sintered body, comprising:

mixing the soft magnetic powder according to claim 4 and an organic binder, thereby obtaining a mixture;

molding the mixture, thereby obtaining a molded body; and firing the molded body, thereby obtaining a sintered body.

* * * * *